US012305468B2

(12) United States Patent
Threadgill

(10) Patent No.: US 12,305,468 B2
(45) **Date of Patent: *May 20, 2025**

(54) SIDE PACKER FOR A BLOWOUT PREVENTER

(71) Applicant: Schlumberger Technology Corporation, Sugar Land, TX (US)

(72) Inventor: Micah Threadgill, Cypress, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/474,586

(22) Filed: Sep. 26, 2023

(65) Prior Publication Data

US 2024/0011363 A1 Jan. 11, 2024

Related U.S. Application Data

(63) Continuation of application No. 17/321,659, filed on May 17, 2021, now Pat. No. 11,802,459, which is a continuation of application No. 15/826,118, filed on Nov. 29, 2017, now abandoned.

(51) Int. Cl.

| | |
|---|---|
| ***E21B 33/06*** | (2006.01) |
| *E21B 47/06* | (2012.01) |
| *E21B 47/07* | (2012.01) |

(52) U.S. Cl.

CPC ..... *E21B 33/063* (2013.01); *E21B 47/06* (2013.01); *E21B 47/07* (2020.05)

(58) Field of Classification Search

CPC ..... E21B 33/063; E21B 33/062; E21B 47/06; E21B 47/07; E21B 47/065; E21B 29/00

See application file for complete search history.

(56) References Cited

U.S. PATENT DOCUMENTS

| | | | | |
|---|---|---|---|---|
| 3,023,994 | A | 3/1962 | Gibson | |
| 3,817,326 | A | 6/1974 | Meynier, III | |
| 3,946,806 | A | 3/1976 | Meynier, III | |
| 5,515,916 | A | 5/1996 | Haley | |
| 6,158,505 | A | 12/2000 | Araujo | |
| 7,207,382 | B2 | 4/2007 | Schaeper | |
| 7,354,026 | B2 | 4/2008 | Urrutia | |
| 8,720,564 | B2 | 5/2014 | Springett et al. | |
| 9,976,373 | B2 | 5/2018 | Araujo et al. | |
| 9,976,374 | B2 | 5/2018 | Araujo et al. | |
| 11,802,459 | B2 * | 10/2023 | Threadgill | E21B 33/063 |
| 2017/0037695 | A1 | 2/2017 | Sedens et al. | |
| 2019/0162040 | A1 | 5/2019 | Threadgill | |
| 2021/0270105 | A1 | 9/2021 | Threadgill | |

* cited by examiner

*Primary Examiner* — Craig M Schneider
*Assistant Examiner* — Andrew J Rost
(74) *Attorney, Agent, or Firm* — Jeffrey D. Frantz

(57) ABSTRACT

The present disclosure relates to a system that includes a ram configured to mount in a blowout preventer. The ram includes a packer assembly configured to form a seal between the ram and a bore formed through the blowout preventer and an insert of the packer assembly, where the insert is coupled to a surface of the ram via a key-slot interface.

15 Claims, 10 Drawing Sheets

SIDE PACKER FOR A BLOWOUT PREVENTER

CROSS-REFERENCE TO RELATED APPLICATIONS

This application is a continuation of U.S. application Ser. No. 17/321,659, which was filed May 17, 2021, which is a continuation of U.S. application Ser. No. 15/826,118, which was filed Nov. 29, 2017. Each of these applications is incorporated herein by reference in its entirety.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A blowout preventer (BOP) stack may be installed on a wellhead to seal and control an oil and gas well during drilling operations. A tubular string may be suspended inside a drilling riser and extend through the BOP stack into the wellhead. During drilling operations, a drilling fluid may be delivered through the tubular string and returned through a bore between the tubular string and a casing of the drilling riser. In the event of a rapid invasion of formation fluid in the bore, commonly known as a "kick," the BOP stack may be actuated to isloate the drilling riser from the wellhead and to control a fluid pressure in the bore, thereby protecting well equipment disposed above the BOP stack.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
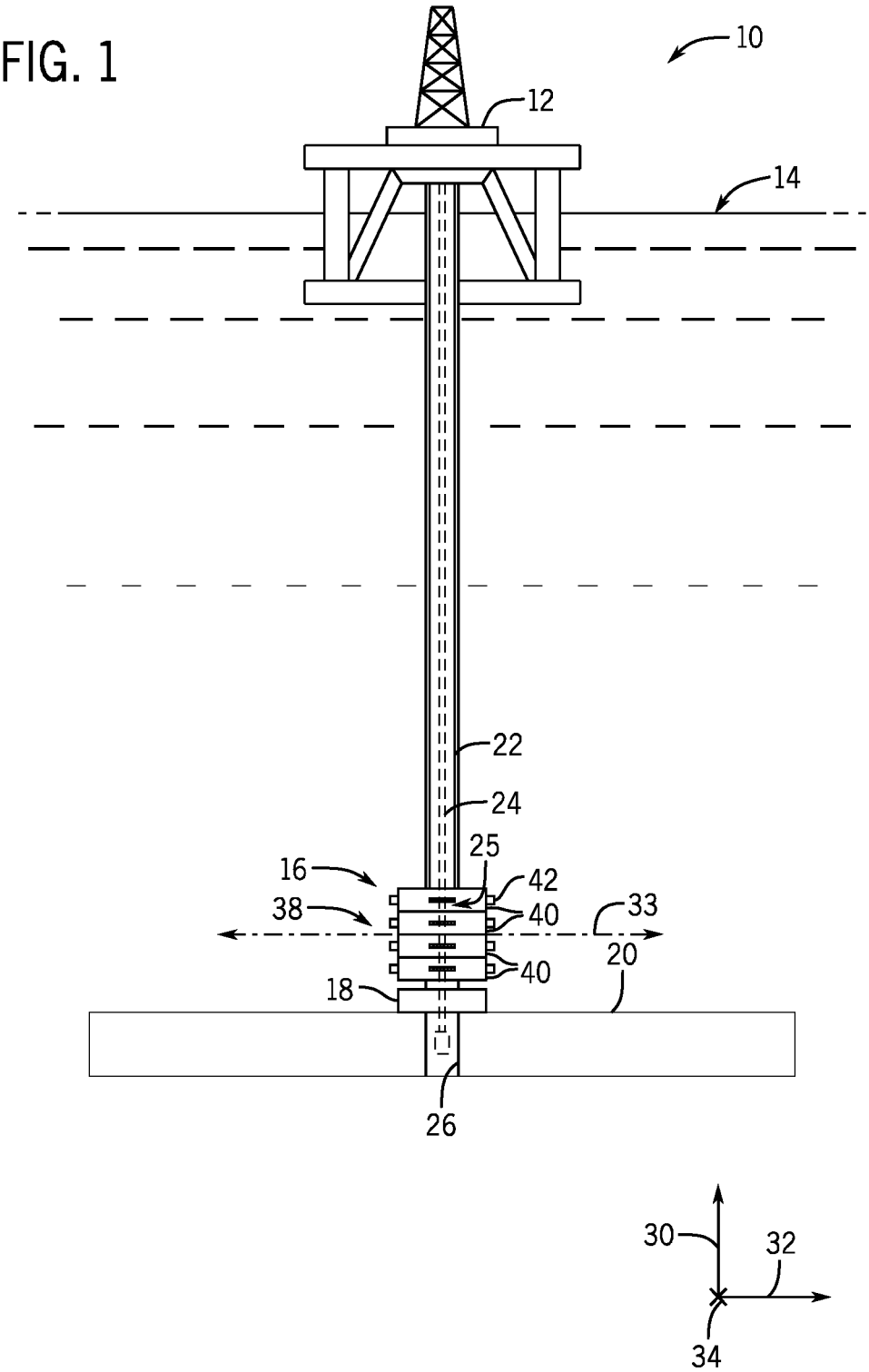
FIG. 1 is a schematic diagram of a mineral extraction system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Embodiments of the present disclosure relate to a blowout preventer ("BOP") system that may include an improved side packer assembly having an increased amount of resilient material to enhance a seal formed by the BOP. A BOP may be included at a wellhead to block a fluid from inadvertently flowing from the wellhead to a drilling platform (e.g., through a drilling riser). For example, pressures may fluctuate within a natural reservoir, which may lead to a surge in fluid flow from the wellhead toward the drilling platform when the pressure reaches a threshold value. To block fluid from flowing toward the drilling platform during a kick and/or a blowout condition, the BOP may be actuated to cover a bore in the BOP that couples the wellhead to the drilling riser. In some cases, rams of the BOP are actuated to engage (e.g., contact and/or cut) a tubular disposed in the bore.

BOP rams may include packer assemblies that are configured to engage a surface of the bore when the BOP rams are actuated to seal the bore and further block a flow of fluid from flowing from the wellhead to the drilling riser. Some packer assemblies are secured to a BOP ram using a fastener, such as a pin, a bolt, a screw, or another suitable fastener. The fastener limits movement of the packer assembly as the BOP ram is actuated to seal the bore. Further, the fastener maintains a connection between the packer assembly and the BOP ram when the BOP ram is retracted to unblock the bore. Unfortunately, machining the BOP ram and the packer assembly to receive the fastener is a precise process that has limited tolerance. As such, machining the BOP ram and packer assembly is complex, time consuming, and expensive. Additionally, the fastener extends into a resilient material of the packer assembly, thereby reducing an amount of resilient material that may be used to form the seal. Additionally, the reduced resilient material may decrease a compressibility of the packer assembly and unevenly distribute forces applied to the packer assembly because of asymmetry caused by the fastener extending through the resilient material. Accordingly, the fastener may reduce a lifespan of the packer assembly and lead to relatively frequent replacement and/or maintenance of the BOP, for example.

In accordance with embodiments of the present disclosure, a packer assembly (e.g., a side packer assembly) of a BOP ram may be coupled to the BOP ram using a key and slot configuration (e.g., interface). For example, a receptacle of the BOP ram may include a protrusion (e.g., a key) that is configured to be disposed in a slot of the packer assembly, or vice versa. In some embodiments, the packer assembly may be configured to move within the receptacle because the protrusion may slide within the slot. Further, a length of the slot may be configured to block movement of the packer assembly and maintain the packer assembly within the receptacle. For example, the protrusion eventually contacts or reaches an end of the slot, and thus, blocks further movement of the packer assembly with respect to the BOP ram. As such, a connection between the packer assembly and the BOP ram is maintained when the BOP ram is moved toward a retracted position to open the bore through the BOP, for example. Additionally, in some embodiments, at least a portion the packer assembly includes a surface having a curvature to facilitate installation of the packer assembly into the receptacle of the BOP ram. The curved surface of the packer assembly may also be configured to retain the packer assembly within the receptacle.

With the foregoing in mind, FIG. 1 is a schematic of an embodiment of a mineral extraction system 10. The mineral extraction system 10 includes a vessel or platform 12 at a surface 14. A BOP stack assembly 16 is mounted to a wellhead 18 at a floor 20 (e.g., a sea floor for offshore operations). A tubular drilling riser 22 extends from the platform 12 to the BOP stack assembly 16. The riser 22 may return drilling fluid or mud to the platform 12 during drilling operations. Downhole operations are carried out by a tubular string 24 (e.g., drill string, production tubing string, or the like) that extends from the platform 12, through the riser 22, through a bore 25 of the BOP stack assembly 16, and into a wellbore 26.

To facilitate discussion, the BOP stack assembly 16 and its components may be described with reference to an axial axis or direction 30, a second axis or direction 32 extending longitudinally along a centerline 33 of the BOP stack assembly 16 (e.g., a longitudinal axis crosswise to the axial axis or direction 30), and a third axis or direction 34 (e.g., a lateral axis crosswise to the axial axis or direction 30 and the second axis or direction 32). As shown, the BOP stack assembly 16 includes a BOP stack 38 having multiple BOPs 40 (e.g., ram BOPs) axially stacked (e.g., along the axial axis 30) relative to one another. As discussed in more detail below, each BOP 40 may include a pair of longitudinally opposed rams and corresponding actuators 42 that actuate and drive the rams toward and away from one another along the second axis 32. Although four BOPs 40 are shown, the BOP stack 38 may include any suitable number of the BOPs 40 (e.g., 1, 2, 3, 4, 5, 6, 7, 8, 9, 10, or more BOPs 40). Additionally, the BOP stack 38 may include any of a variety of different types of rams. For example, in certain embodiments, the BOP stack 38 may include one or more BOPs 40 having opposed shear rams or blades configured to sever the tubular string 24 and seal off the wellbore 26 from the riser 22 and/or one or more BOPs 40 having opposed pipe rams configured to engage the tubular string 24 and to seal the bore 25 (e.g., an annulus around the tubular string 24).

Figure 2:
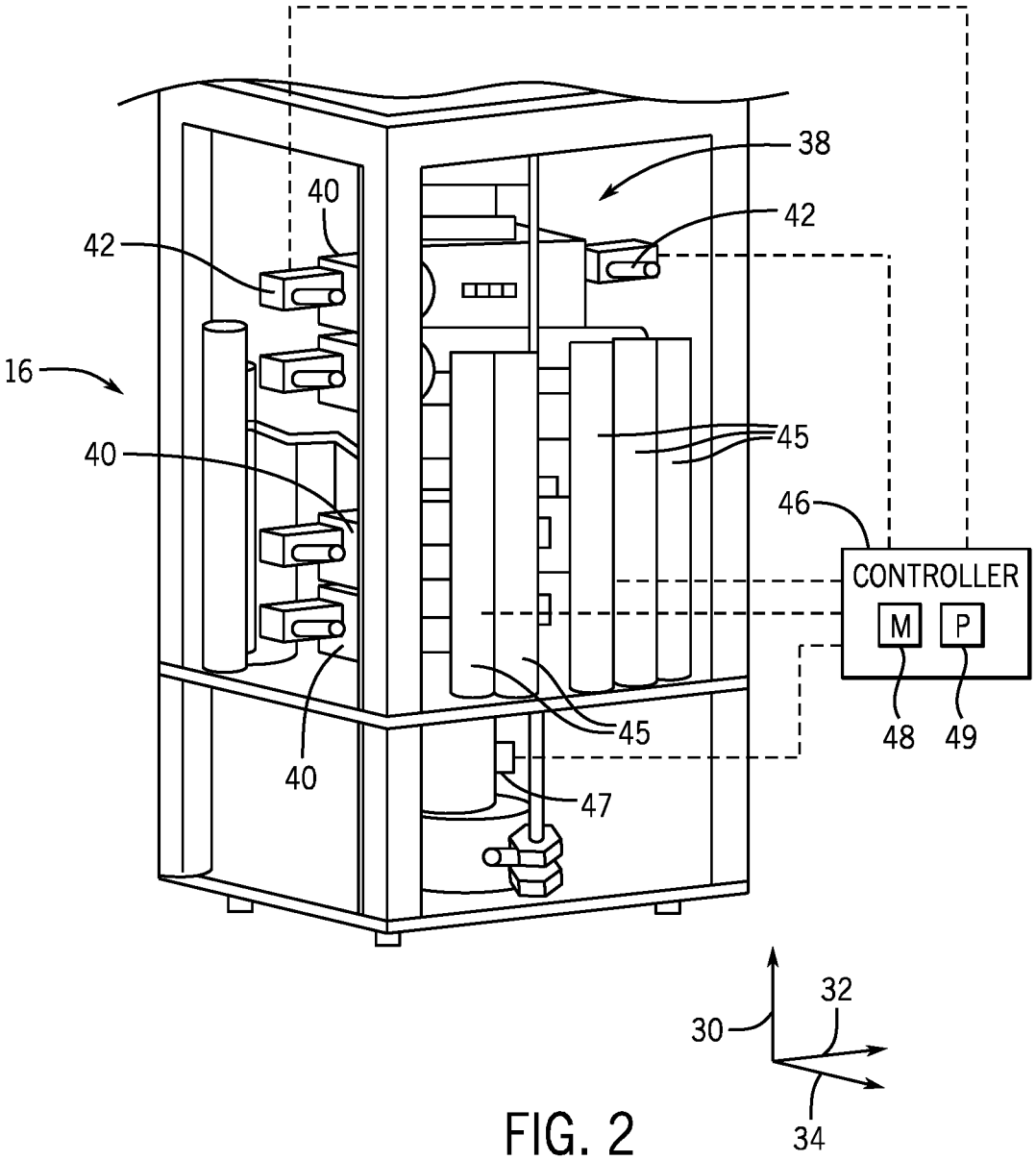
FIG. 2 is a perspective view of an embodiment of a BOP stack assembly that may be used in the mineral extraction system of FIG. 1, in accordance with an embodiment of the present disclosure.

FIG. 2 is a perspective view of an embodiment of the BOP stack assembly 16. As discussed above, the BOP stack 38 includes multiple BOPs 40 axially stacked (e.g., along the axial axis 30) relative to one another. As shown, the BOP stack 38 also includes one or more accumulators 45 (e.g., hydraulic accumulators, pneumatic accumulators, electric accumulators, etc.). In some embodiments, the accumulators 45 store and/or supply (e.g., via one or more pumps) hydraulic pressure to the actuators 42 that are configured to drive the rams of the BOPs 40. In certain embodiments, the accumulators 45 and/or the actuators 42 may be communicatively coupled to a controller 46. The controller 46 may be configured to send signals to the accumulators 45, the actuators 42, and/or one or more pumps to drive the rams of the BOPs 40 when blowout conditions exist. For example, the controller 46 may receive feedback from one or more sensors 47 (e.g., pressure sensors, temperature sensors, flow sensors, vibration sensors, and/or composition sensors) that may monitor conditions of the wellbore 26 (e.g., a pressure of the fluid in the wellbore 26). The controller 46 may include memory 48 that stores threshold values indicative of blowout conditions. Accordingly, a processor 49 of the controller 46 may send a signal instructing the accumulators 45, the actuators 42, and/or the one or more pumps to drive and/or actuate the rams to a closed position when measured feedback received from the controller 46 meets or exceeds such threshold values.

Figure 3:
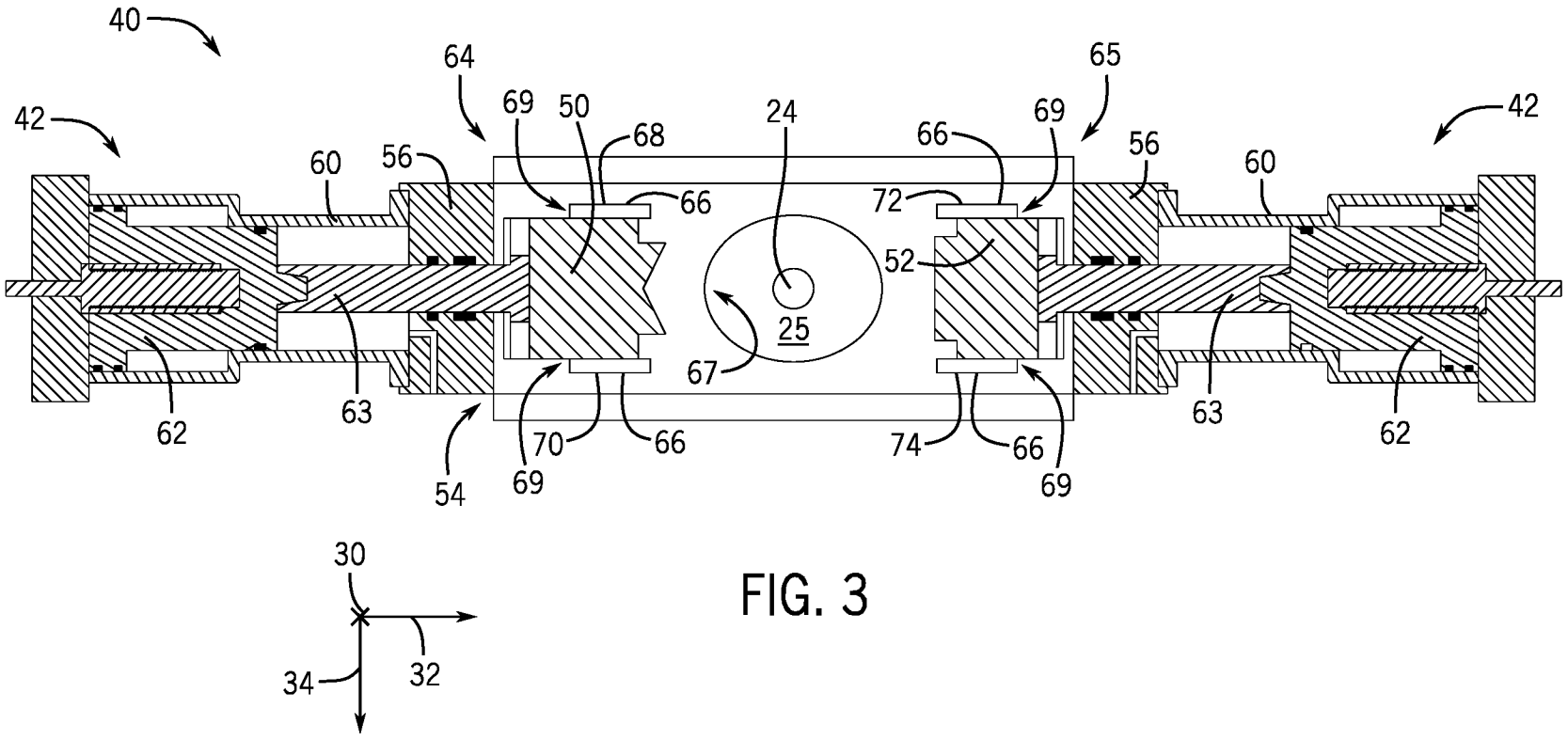
FIG. 3 is a cross-sectional top view of a portion of a BOP of the BOP stack assembly of FIG. 2, illustrating first and second rams in an open position, in accordance with an embodiment of the present disclosure.

FIG. 3 is a cross-sectional top view of a portion of one BOP 40 with a first ram 50 and a second ram 52 in an open or default position 54. In the default position 54, the first ram 50 and the second ram 52 are withdrawn or retracted from the bore 25, do not contact the tubular string 24, and/or do not contact the corresponding opposing ram 50, 52. As shown, the BOP 40 includes a body 56 (e.g., housing) surrounding the bore 25. The body 56 is generally rectangular in the illustrated embodiment, although the body 56 may have any cross-sectional shape, including any polygonal shape or an annular shape. A plurality of bonnet assemblies 60 are mounted to the body 56 (e.g., via threaded fasteners). In the illustrated embodiment, first and second bonnet assemblies 60 are mounted to diametrically opposite sides of the body 56. Each bonnet assembly 60 supports an actuator 42, which includes a piston 62 and a connecting rod 63. As shown in the illustrated embodiment of FIG. 3, when in the default position 54, the first ram 50 is generally adjacent to a first end 64 of the body 56 and the second ram 52 is generally adjacent to a second end 65, opposite the first end 64, of the body 56. The actuators 42 may drive the first and second rams 50, 52 toward and away from one another along the second axis 32 and through the bore 25 to contact and/or shear the tubular string 24 to seal the bore 25. While the illustrated embodiment of FIG. 3 shows the first and second rams 50, 52 as shearing rams, embodiments of the present disclosure may be applied to any suitable type of BOP ram.

The first and second rams 50, 52 may each include one or more packer assemblies 66 (e.g., side packer assemblies) that are configured to engage a surface 67 (e.g., annular surface) of the bore 25 to enhance a seal formed by the BOP 40. For example, as shown in the illustrated embodiment of FIG. 3, the first ram 50 may include a first packer assembly 68 and a second packer assembly 70 positioned on opposite lateral sides of the first ram 50. Further, the second ram 52 may include a third packer assembly 72 and a fourth packer assembly 74 positioned on opposite sides of the second ram 52. The packer assemblies 66 are configured to engage the surface 67 and block fluid from flowing between the surface 67 and the first and second rams 50, 52 toward the platform 12 while the BOP 40 is in a closed position. In some embodiments, the packer assemblies 66 may be configured to move along the second axis 32 with respect to corresponding receptacles of the first and second rams 50, 52. For example, when the first and second rams 50, 52 are moved toward one another to the closed position in which the first and second rams 50, 52 seal the bore 25, the first and second packer assemblies 68, 70 may be configured to engage the third and fourth packer assemblies 72, 74, respectively, which may cause the packer assemblies 66 to move within the respective receptacles. Because a portion of the packer assemblies 66 may include a resilient material (e.g., compressible or elastic material), the packer assemblies 66 may compress longitudinally and expand laterally outward to contact the surface 67 of the bore 25 to enhance a seal of the bore 25 formed by the BOP 40.

Figure 4:
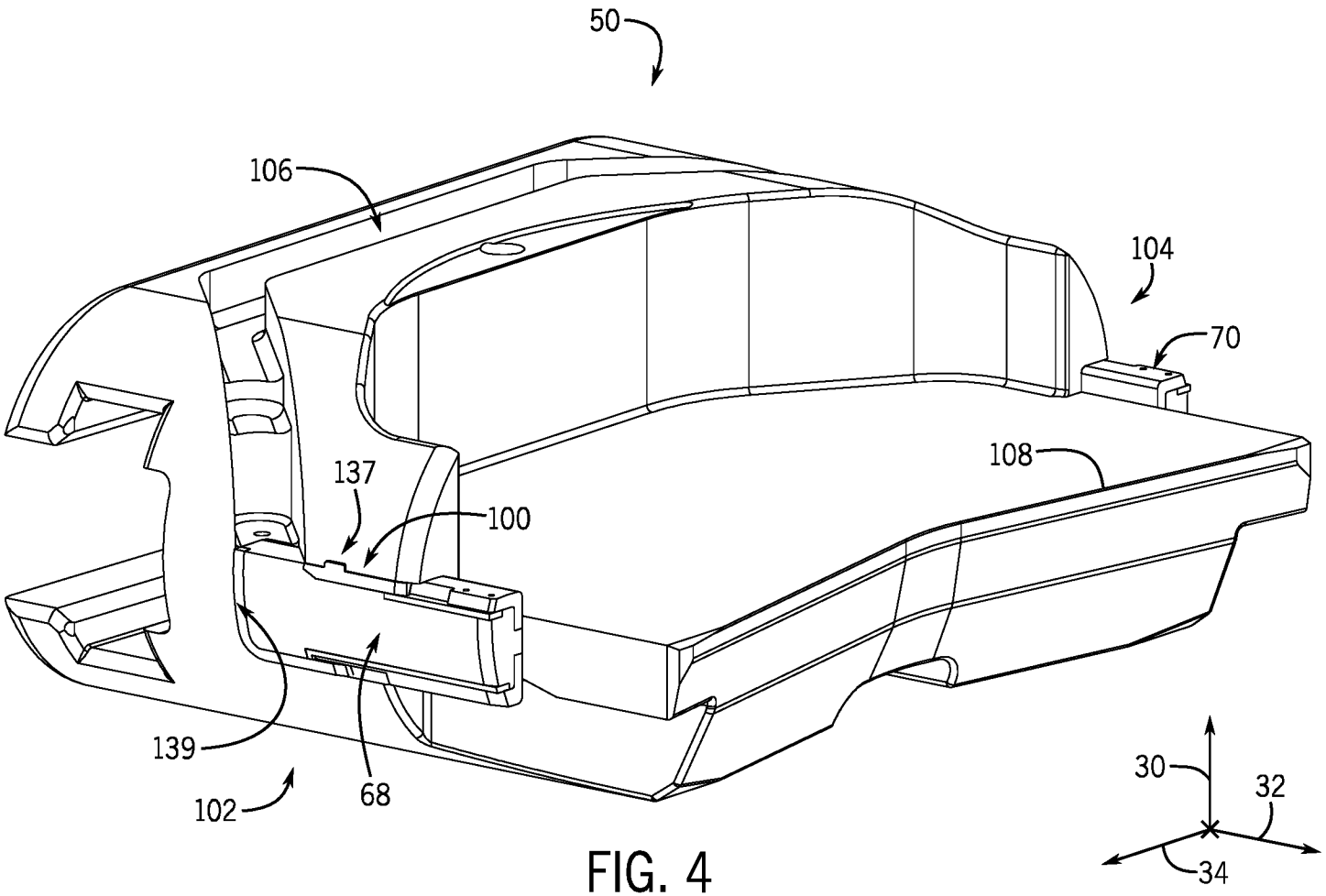
FIG. 4 is a perspective view of an embodiment of a ram that may be included in the BOP of FIG. 3, in accordance with an embodiment of the present disclosure.

As discussed above, the packer assemblies 66 may be coupled to the first and second rams 50, 52 via a key-slot interface 69. For example, the packer assemblies 66 may include a slot that may receive a protrusion formed in a receptacle of the first and second rams 50, 52. In other embodiments, the packer assemblies 66 include the protrusion which is disposed in a corresponding slot formed in the receptacle of the first and second rams 50, 52. Accordingly, such a configuration may facilitate manufacture and installation of the packer assemblies 66. For example, FIG. 4 is a perspective view of an embodiment of the ram 50, which may include the packer assembly 68. As shown in the illustrated embodiment of FIG. 4, the packer assembly 68 is disposed within a receptacle 100 (e.g., a channel, a groove, a slot, an opening, a cavity) of the ram 50. As discussed in detail below with reference to FIGS. 8 and 9, the packer assembly 68 may be secured in the receptacle 100 via a friction fit interface. The packer assembly 68 may snap into the receptacle 100 and/or be driven into the receptacle 100 (e.g., via a plastic mallet or hammer).

As shown in the illustrated embodiment of FIG. 4, the packer assembly 68 is positioned on a side 102 (e.g., a first lateral side) of the ram 50, and thus, forms a seal between the ram 50 and the surface 67 of the bore 25. Further, the packer assembly 70 is positioned on a side 104 (e.g., a second lateral side) of the ram 50, opposite the side 102, to form a seal between the ram 50 and the surface 67 of the bore 25. Further, the ram 50 may include a channel 106, which may receive a sealing member to further enhance the seal of the bore 25. In any case, the ram 50 is configured to be actuated along the axis 32 toward the bore 25, such that the ram 50 engages the second ram 52 to seal the bore 25. In the illustrated embodiment of FIG. 4, the ram 50 includes a shearing edge 108 configured to shear the tubular string.

Figure 5:
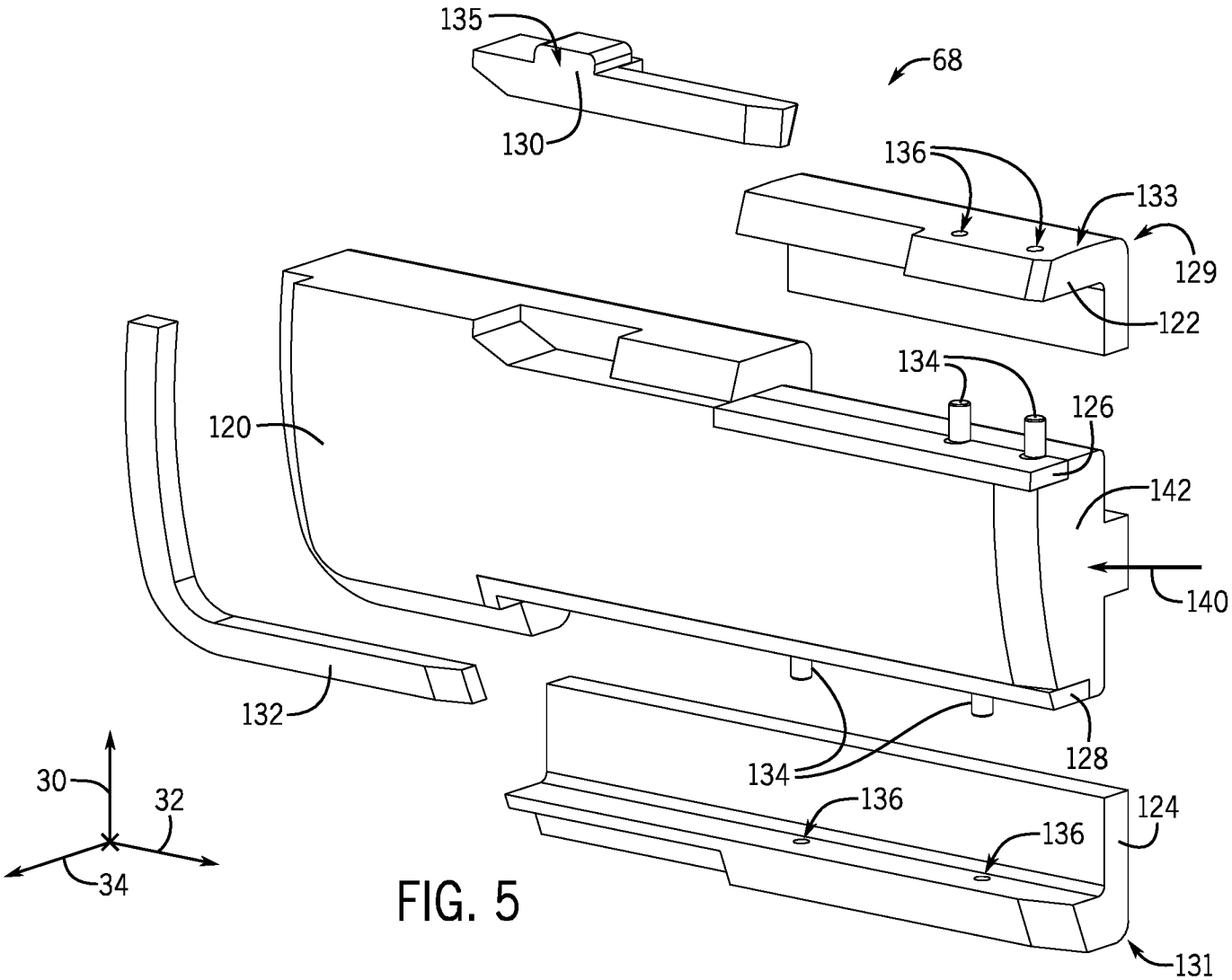
FIG. 5 is an exploded perspective view of an embodiment of a packer assembly that may be used with the ram of FIG. 4, in accordance with an embodiment of the present disclosure.

FIG. 5 is an exploded perspective view of an embodiment of the packer assembly 68, which may include a variety of components. As shown in the illustrated embodiment of FIG. 5, the packer assembly 68 includes a packing element 120, a first insert 122, a second insert 124, a first structural support 126, a second structural support 128, a first member 130, and a second member 132. In some embodiments, the first structural support 126 and the second structural support 128 are utilized to provide support to the packing element 120, which may include a resilient, flexible, elastic, and/or compressible material. Additionally or alternatively, the first structural support 126 and the second structural support 128 may provide an interface for the packer assembly 68 for contacting a corresponding packer assembly (e.g., the third packer assembly 72 or the fourth packer assembly 74) as the first and second rams 50, 52 are actuated toward one another. As such, the first structural support 126 and/or the second structural support 128 may absorb at least a portion of the force between the packer assembly 68 and the corresponding packer assembly upon contact.

The first structural support 126 may be coupled to the first insert 122 and/or the packing element 120, and the second structural support 128 may be coupled to the second insert 124 and/or the packing element 120 using one or more fasteners 134 (e.g., pins) disposed within corresponding openings 136 within the first insert 122 and the second insert 124. The first insert 122 and the second insert 124 may facilitate insertion of the packer assembly 68 into the receptacle 100 of the ram 50. For example, a first rounded corner 129 of the first insert 122 and a second rounded corner 131 of the second insert 124 may enable the packer assembly 68 to snap into the receptacle 100. Further, the first insert 122 and the second insert 124 may secure the packer assembly 68 in the receptacle 100. As discussed in detail below with reference to FIGS. 8 and 9, the first insert 122 includes a rounded (e.g., curved) surface 133, which enables the packer assembly 68 to remain in the receptacle 100.

Further still, the first structural support 126, the second structural support 128, the first member 130, and/or the second member 132 enable the packing element 120 of the packer assembly 68 to compress longitudinally, while maintaining substantially the same structure of the packer assembly 68 upon compression (e.g., the first structural support 126, the second structural support 128, the first member 130, and/or the second member 132 are substantially rigid). In some embodiments, the first member 130 and the second member 132 may remain substantially stationary relative to the ram 50 as the packing element 120 of the packer assembly 68 is compressed longitudinally due to contact with the corresponding packer assembly 66 of the second ram 52. In some embodiments, the first member 130 includes a protrusion 135 that is disposed into a corresponding groove 137 (see, e.g., FIG. 4) of the receptacle 100. The corresponding groove 137 blocks movement of the first member 130 relative to the ram 50 during compression of the packing element 120, such that the first member 130 is substantially stationary relative to the ram 50. As such, the packing element 120 compresses longitudinally as the packing element 120 is driven toward the first member 130 due to a force 140 exerted on a surface 142 of the packer assembly 68 by a corresponding packer assembly 66 of the second ram 50.

Further, a wall 139 (see, e.g., FIG. 4) of the receptacle 100 blocks movement of the second member 132 as the packing element 120 is compressed (e.g., contacted by a corresponding packing assembly 66 of the ram 52). During compression of the packing element 120, the first insert 122 and the second insert 124 are driven away from the bore 25 and slide toward the first member 130 and the second member 132, respectively, as a result of contact with a corresponding packer assembly 66 of the ram 52. As discussed above, the first insert 122 and the second insert 124 are coupled to the packing element 120 via the fasteners 134 and/or the first structural member 126 and the second structural member 128. Thus, the first member 130 and the second member 132 may block movement of the packing member 120 within the receptacle, such that the packing member 120 compresses longitudinally. As such, the packing element 120 expands laterally outwardly away from the ram 50 and toward the surface 67 of the bore 25. Contact between the packing member 120 and the surface 67 seals the bore 25 and blocks fluid from flowing between the ram 50 and the surface 67.

In some embodiments, the packing member 120, the first insert 122, the second insert 124, the first structural support 126, the second structural support 128, the first member 130, and/or the second member 132 may be coupled to one another to form a single-packaged unit that maintains a structural shape substantially similar to a cross-sectional shape of the receptacle 100. As such, the packer assembly 68 may be disposed in the receptacle 100 by snapping each of the components of the packer assembly 68 into the receptacle 100 substantially simultaneously.

Figure 6:
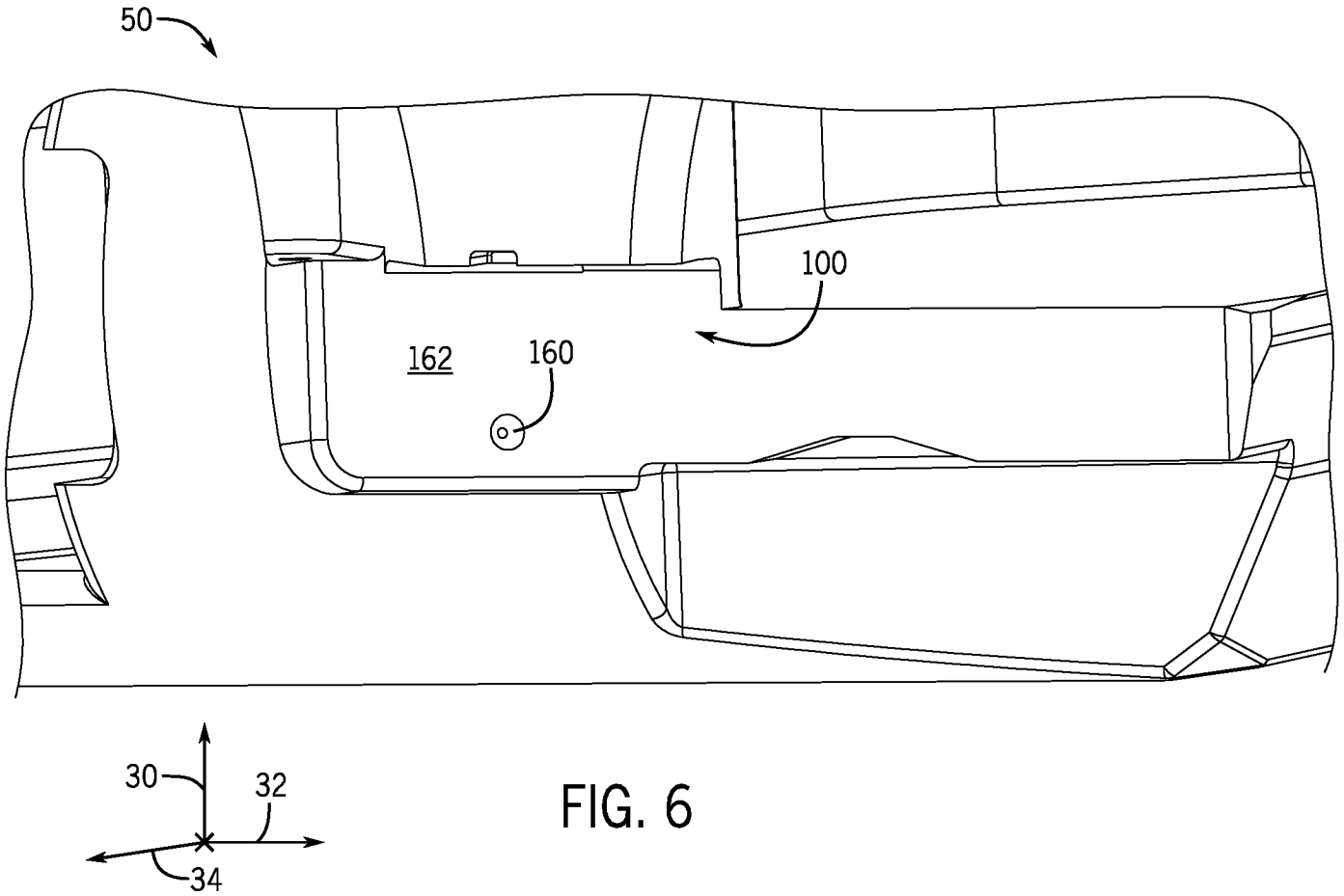
FIG. 6 is a perspective view of an embodiment of a receptacle of the ram of FIG. 4, which may receive the packer assembly of FIG. 5, in accordance with an embodiment of the present disclosure.

As discussed above, the packer assembly 68 may not include a fastener (e.g., threaded fastener) to secure the packer assembly 68 to the ram 50. Instead, the packer assembly 68 may be secured to the ram 50 via the rounded surface 136 and/or a key and slot interface between the packer assembly 68 and the ram 50. For example, FIG. 6 is a perspective view of an embodiment of the ram 50 having a protrusion 160 (e.g., a key, a pin, or another protrusion or projection extending laterally from a surface of the ram 50) on a surface 162 of the receptacle 100. As shown in the illustrated embodiment of FIG. 6, the protrusion 160 includes a substantially dome shape (e.g., half spherical). However, in other embodiments, the protrusion 160 may include a cube shape, another prismatic shape, or any other suitable shape. In any case, the protrusion 160 is configured to be disposed within a corresponding slot 180 of the packer assembly 68.

Figure 7:
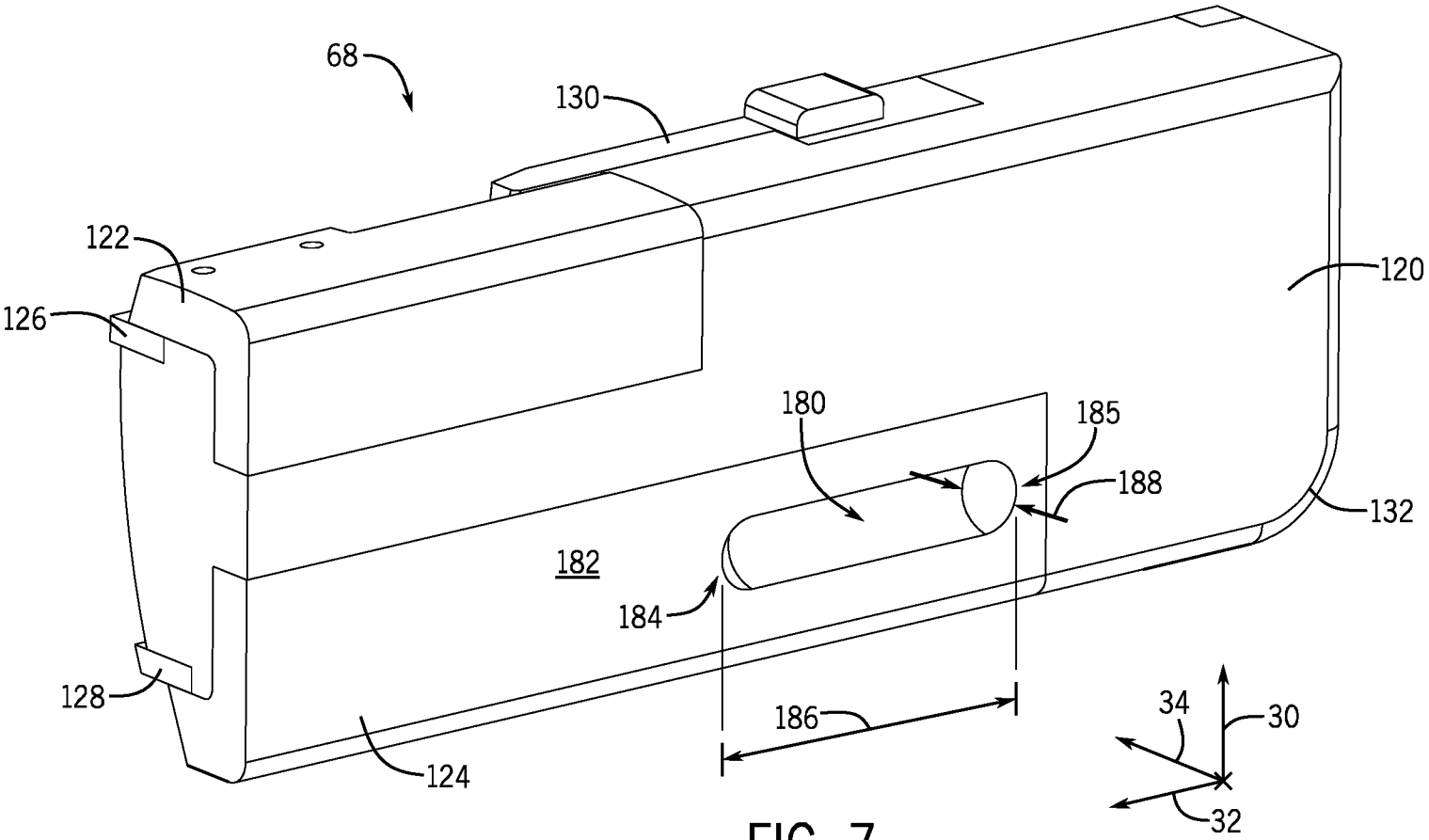
FIG. 7 is a perspective view of an embodiment of the packer assembly of FIG. 5, in accordance with an embodiment of the present disclosure.

For instance, FIG. 7 is a perspective view of the packer assembly 68 showing the slot 180 formed in the second insert 124. As shown in the illustrated embodiment of FIG. 7, the slot 180 is a groove or indentation formed within a surface 182 of the second insert 124, where the surface 182 is configured to abut the surface 162 of the receptacle 100 when the packer assembly 68 is disposed in the receptacle 100. The slot 180 is configured to receive the protrusion 160, such that the protrusion 160 slides longitudinally within the slot 180 (e.g., the slot 180 slides over the protrusion 160) when the packer assembly 68 compresses longitudinally upon contact with a corresponding packer assembly 66 of the second ram 52. Thus, the protrusion 160 and the slot 180 may at least partially determine an amount of compression of the packing element 120 because movement of the second insert 124 may be blocked when the protrusion 160 reaches an end 184 (e.g., a first end) of the slot 180.

Further, the protrusion 160 and the slot 180 may retain the packer assembly 68 within the receptacle 100 as the ram 50 is retracted to the default position 54 and as the packing element 120 decompresses. For example, as the ram 50 is directed away from the bore 25 along the second axis 32, the packer assembly 68 may remain substantially stationary with respect to the bore 25 along the second axis 32. Therefore, the ram 50 moves independent of the packer assembly 68. As such, the protrusion 160 moves within the slot 180 until the protrusion 160 contacts an end 185 (e.g., a second end), which blocks movement of the ram 50 independent of the packer assembly 68. The packer assembly 68 may then move with the ram 50 away from the bore 25, and thus, remain within the receptacle 100 of the ram 50. The protrusion 160 and the slot 180 therefore enable a predetermined amount of compression of the packing element 120 when the first ram 50 is actuated toward the bore 25 and the second ram 52 to seal the bore 25 and retains the packer assembly 68 within the receptacle 100 when the first ram 50 is actuated away from the bore 25 and the second ram 52. Moreover, due to the configuration of the packer assembly 68 and/or because the packer assembly 68 is not coupled to the ram 50 using a fastener, the packing element 120 may include an increased amount of resilient material, which may enable increased contact between the surface 67 of the bore 25 and the packer assembly 68, thereby enhancing a seal of the bore 25.

As shown in the illustrated embodiment of FIG. 7, the slot 180 includes a length 186, which may enable the protrusion 160 to slide within the slot 180 a sufficient distance to compress the packing element 120 and form the seal of the bore 25. For example, in some embodiments, the length 186 of the slot 180 may be between 1 centimeter (cm) and 13 cm (e.g., approximately 0.5 inches and 5 inches), between 2 cm and 8 cm (e.g., approximately 0.75 inches and 3 inches), or between 3 cm and 5 cm (e.g., approximately 1 inches and 2 inches). In other embodiments, the length 186 of the slot 180 may be approximately (e.g., within 10% of, within 5% of, or within 1% of) 4 cm (e.g., approximately 1.5 inches). In still further embodiments, the length 186 of the slot 180 may be scaled or adjusted to any suitable length based on a size of the ram 50, a size of the packer assembly 86, a size of the receptacle 100, a size of the BOP 40, or a combination thereof. Additionally, or alternatively, the slot 180 includes a depth 188, which may correspond to a length 190 (see, e.g., FIG. 8) of the protrusion 160. In some embodiments, the depth 180 may be greater than the length 190 to enable the surface 182 of the packer assembly 68 to contact the surface 162 of the receptacle 100. For example, the depth may be between 0.3 centimeters (cm) and 3 cm (e.g., approximately 0.1 inches and 1 inch), between 0.4 cm and 2 cm (e.g., approximately 0.15 inches and 0.75 inches), or between 0.5 cm and 0.8 cm (e.g., approximately 0.2 inches and 0.3 inches). In some embodiments, the depth 188 of the slot 180 may be approximately (e.g., within 10% of, within 5% of, or within 1% of) 0.7 cm (e.g., approximately 0.25 inches).

Further, the slot 180 forms a substantially curved or elliptical shape that is configured to conform to a shape of the protrusion 160. As such, a shape of the slot 180 may be determined at least partially by the shape of the protrusion 160 to facilitate movement of the protrusion 160 within the slot 180. In any case, the protrusion 160 and the slot 180 are configured to retain the packer assembly 68 within the receptacle 100 as the packing element 120 undergoes compression and decompression.

Figure 8:
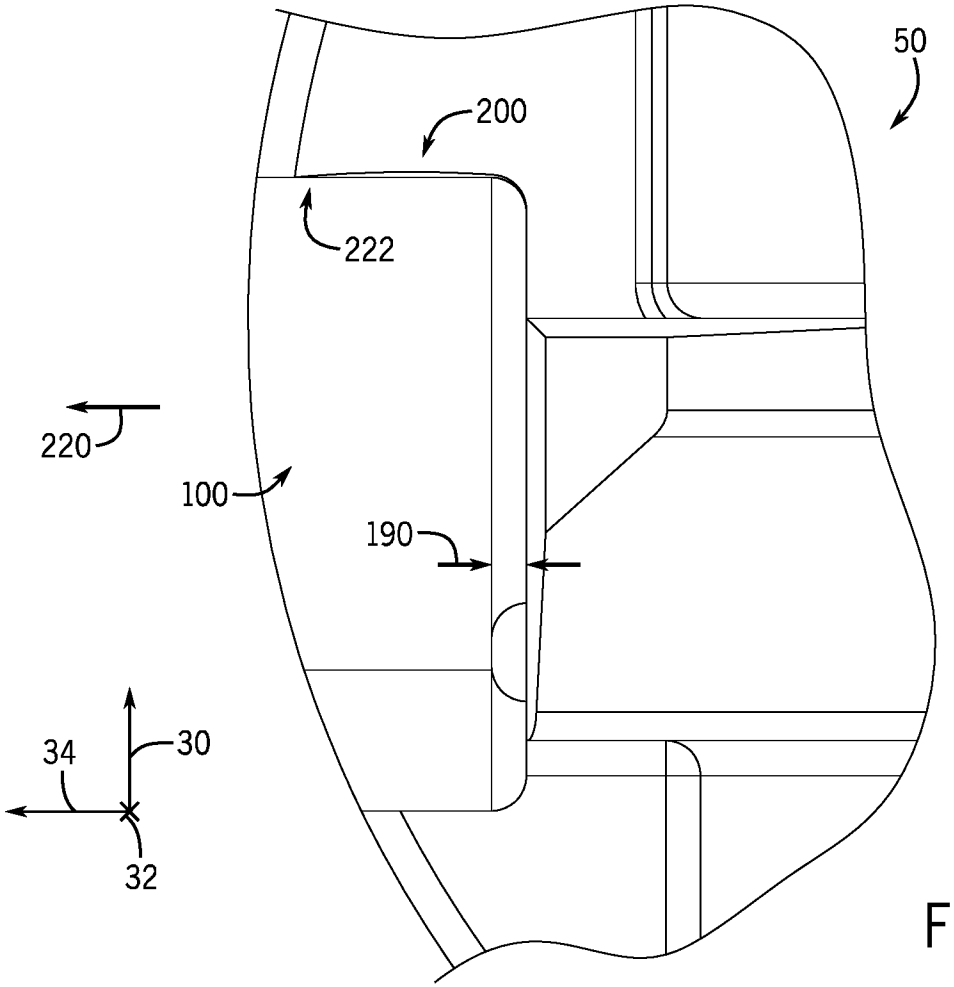
FIG. 8 is an elevation view of an embodiment of the receptacle of FIG. 6, in accordance with an embodiment of the present disclosure.
Figure 9:
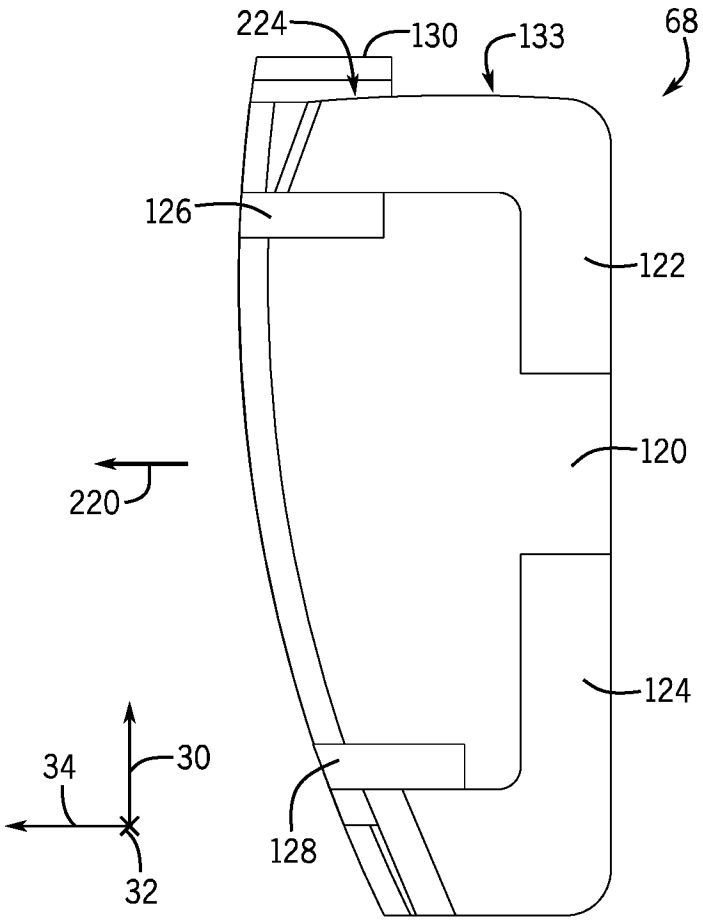
FIG. 9 is an elevation view of an embodiment of the packer assembly of FIGS. 5 and 7, in accordance with an embodiment of the present disclosure.

Further, a profile of the packer assembly 68 (e.g., the first insert 122) may secure the packer assembly 68 in the receptacle 100. In other words, the profile of the packer assembly 68 blocks movement of the packer assembly 68 away from the ram 50 along the third axis 34. For example, FIGS. 8 and 9 are elevation views of the receptacle 100 and the packer assembly 68, respectively. As shown in the illustrated embodiment of FIG. 8, the receptacle 100 includes a surface 200 that has a curvature that substantially mirrors a curvature of the surface 133 of the first insert 122 of the packer assembly 68 (see, e.g., FIG. 9). The curvature of the surface 200 of the receptacle 100 and the corresponding curvature of the surface 133 of the first insert 122 may block movement of the packer assembly (e.g., the first insert 122 and the second insert 124) away from the ram 50 along the third axis 34. For example, as shown in the illustrated embodiment of FIG. 8, the curvature of the surface 200 is generally concave with respect to the receptacle 100. As such, the concave shape of the surface 200 enables the surface 200 to block movement of the packer assembly in a direction 220 because of contact between the surface 133 and the surface 200. In other words, a downward sloping portion 222 of the surface 200 contacts an upward sloping portion 224 of the surface 133 to block movement of the packer assembly 68 in the direction 220. Thus, the packer assembly 68 is retained within the receptacle 100 and blocked from movement in the direction 220 along the third axis 34.

Figure 10:
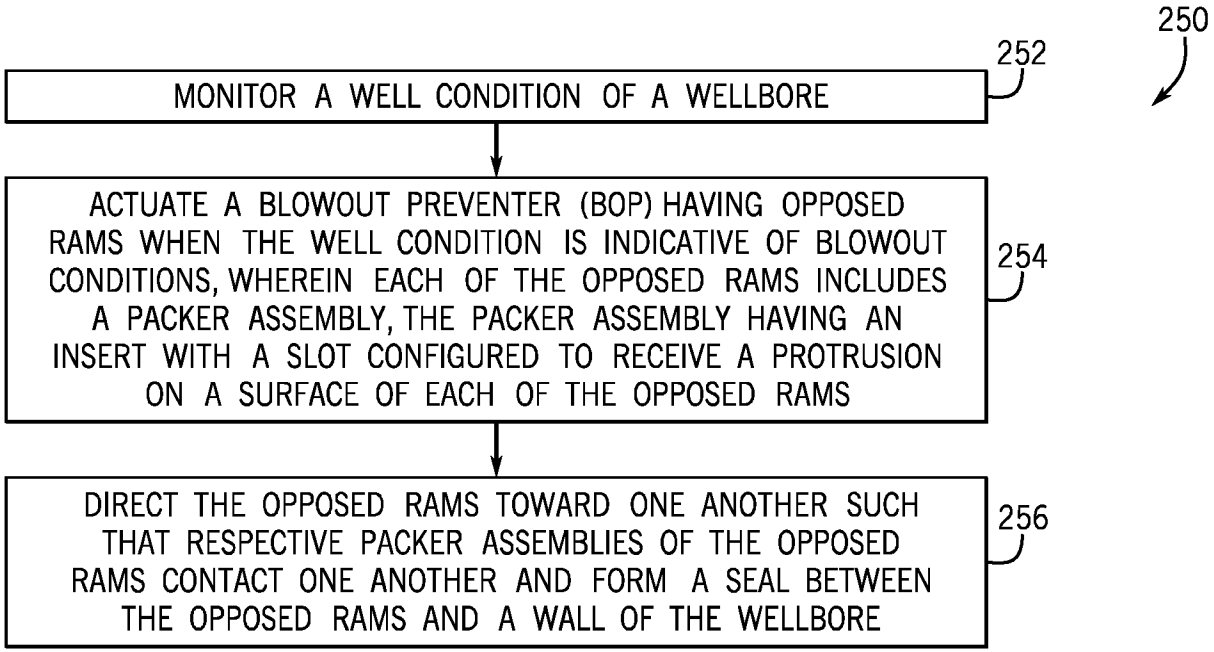
FIG. 10 is a block diagram of an embodiment of a process for utilizing the ram and packer assembly of FIGS. 4-9, in accordance with an embodiment of the present disclosure.

FIG. 10 is a flow chart of an embodiment of a process 250 for utilizing the ram 50 and the packer assembly 68 of the BOP 40. For example, at block 252, the controller 46 may be configured to monitor a condition (e.g., a fluid pressure, a fluid temperature, a fluid flow rate, or another suitable operating parameter) of the wellbore 26. In some embodiments, the tubular string 24 is disposed into the wellbore 26, and thus, may pass through the bore 25 of the BOP 40. As discussed above, in some cases, the bore 25 is sealed to block a flow of fluid from the wellbore 26 toward the platform 12. For example, the wellbore 26 may experience a relatively high pressure (e.g., a kick or blowout conditions), which may ultimately result in inadvertent flow of fluid from the wellbore 26 toward the platform 12. As such, the controller 46 may receive feedback from the one or more sensors 47 and process the feedback to determine whether to seal the bore 25 with the BOP 40.

When the controller 46 determines that the bore 25 should be sealed (e.g., the wellbore 26 is experiencing blowout conditions), the controller 46 may send one or more signals to actuate the BOP 40, as shown at block 254. As discussed above, the BOP 40 includes the first and second rams 50 and 52, which may each include one or more packer assemblies 66 coupled to the first and second rams 50 and 52 via respective key-slot interfaces 69. Each of the packer assemblies 66 include the first insert 122 and/or the second insert 124, which may include the slot 180. When the packer assemblies 66 are disposed in respective receptacles 100 of the rams 50, 52, the slot 180 may engage the protrusion 160 positioned on the surface 162 of the receptacle 100, for example.

In any case, at block 256, the first and second rams 50 and 52 are moved toward one another such that the first packer assembly 68 engages the third packer assembly 72 and/or the second packer assembly 70 engages the fourth packer assembly 74. The packer assemblies 66 may then compress, such that the packing element 120 is compressed longitudinally and expanded laterally outward from the receptacle 100 toward the surface 67 of the bore 25 to form a seal between the rams 50 and 52 and the surface 67. As such, fluid may be substantially blocked from flowing from the wellbore 26 to the platform 12. As noted above, the protrusion 160 may be configured to move within the slot 180 as the packer assemblies 66 are compressed (e.g., when corresponding packer assemblies 66 on the first ram 50 and the second ram 52 engage one another). Further, the protrusion 160 may engage the end 185 of the slot to retain the packer assemblies 66 within the respective receptacles 100 when the rams 50, 52 are retracted and/or directed away from one another with respect to the bore 25.

While the present disclosure may be susceptible to various modifications and alternative forms, specific embodiments have been shown by way of example in the drawings and have been described in detail herein. However, it should be understood that the present disclosure is not intended to be limited to the particular forms disclosed. Rather, the present disclosure is to cover all modifications, equivalents, and alternatives falling within the spirit and scope of the present disclosure as defined by the following appended claims.

The invention claimed is:

1. A system, comprising:

a ram configured to mount in a blowout preventer; and a packer assembly configured to form a seal between the ram and a bore formed through the blowout preventer, wherein the packer assembly comprises:

a packing element formed of a first material, wherein the packing element extends from a first end to a second end along a longitudinal axis and is configured to expand along a lateral axis to form the seal; and a first insert formed of a second material different from the first material, wherein the first insert supports the packing element and is coupled to a surface of the ram via a key-slot interface positioned between the first end and the second end of the packing element along the longitudinal axis, wherein the ram comprises a receptacle and the packer assembly is configured to move within the receptacle, the packing element further comprising a second insert, wherein the second insert comprises a rounded surface configured to engage a corresponding surface of the receptacle, wherein a protrusion of the key-slot interface is configured to slide within a slot of the key-slot interface to enable the packer assembly to move within the receptacle, and the protrusion is configured to engage an end of the slot to block movement of the packer assembly within the receptacle, and wherein the protrusion is disposed on the surface of the ram and the slot is formed in the first insert.

2. The system of claim 1, wherein the rounded surface comprises an upward sloping portion that is configured to engage a downward sloping portion of the corresponding surface of the receptacle, thereby blocking movement of the packer assembly out of the receptacle.

3. The system of claim 1, further comprising one or more structural supports of the packer assembly, wherein the one or more structural supports are configured to substantially maintain a shape of the packer assembly during compression of the packer assembly.

4. The system of claim 1, wherein the first material is a resilient material and the second material is a rigid material.

5. The system of claim 1, wherein the surface of the ram comprises a laterally-facing surface of the ram.

6. The system of claim 5, wherein the protrusion extends laterally-outwardly from the laterally-facing surface of the ram to engage the slot formed in the first insert to form the key-slot interface.

7. The system of claim 1, wherein the surface of the ram comprises a laterally-facing surface of the receptacle.

8. The system of claim 1, wherein the ram is a shearing ram.

9. A system, comprising:

a ram configured to mount in a blowout preventer; and a packer assembly configured to form a seal between the ram and a bore formed through the blowout preventer, wherein the packer assembly comprises:

a packing element formed of a first material, wherein the packing element extends from a first end to a second end along a longitudinal axis and is configured to expand along a lateral axis to form the seal; and an insert formed of a second material different from the first material, wherein the insert supports the packing element and is coupled to a surface of the ram via a key-slot interface positioned between the first end and the second end of the packing element along the longitudinal axis;

wherein the ram comprises a receptacle and the packer assembly is configured to move within the receptacle, wherein a protrusion of the key-slot interface is configured to slide within a slot of the key-slot interface to enable the packer assembly to move within the receptacle, and the protrusion is configured to engage an end of the slot to block movement of the packer assembly within the receptacle, and wherein the protrusion is disposed on the surface of the ram and the slot is formed in the insert, the packer assembly further comprising one or more structural supports configured to substantially maintain a shape of the packer assembly during compression of the packer assembly.

10. The system of claim 9, wherein the first material is a resilient material and the second material is a rigid material.

11. The system of claim 9, wherein the surface of the ram comprises a laterally-facing surface of the ram.

12. The system of claim 11, wherein the protrusion extends laterally-outwardly from the laterally-facing surface of the ram to engage the slot formed in the insert to form the key-slot interface.

13. The system of claim 9, wherein the surface of the ram comprises a laterally-facing surface of the receptacle.

14. The system of claim 9, wherein the ram is a shearing ram.

15. A method, comprising:

monitoring a well condition of a wellbore;

actuating a blowout preventer having a first ram and a second ram in response to the well condition being indicative of blowout conditions, wherein the first ram comprises a packer assembly comprising an insert that is coupled to a ram body of the first ram via a key-slot interface, the insert comprising a slot configured to receive a protrusion disposed on a laterally-facing surface of the respective ram body;

directing the first ram and the second ram toward one another such that the insert contacts a portion of the second ram to drive the packer assembly to move relative to the ram body of the first ram via the key-slot interface and to facilitate formation of a seal between the first ram and a wall of a bore extending through the blowout preventer;

retracting the first ram and the second ram away from one another; and blocking movement of the packer assembly with respect to the ram body of the first ram when the protrusion contacts an end of the slot, such that the packer assembly is maintained within a receptacle of the ram body, wherein the packer assembly further comprises a packing element comprising a resilient material that extends from a first end to a second end along a longitudinal axis and is configured to expand along a lateral axis to form the seal, and the slot is positioned between the first end and the second end of the resilient material along the longitudinal axis.

* * * * *